United States Patent [19]

Maringer

[11] Patent Number: 4,479,528

[45] Date of Patent: Oct. 30, 1984

[54] STRIP CASTING APPARATUS

[75] Inventor: Robert E. Maringer, Worthington, Ohio

[73] Assignee: Allegheny Ludlum Steel Corporation, Pittsburgh, Pa.

[21] Appl. No.: 394,587

[22] Filed: Jul. 2, 1982

Related U.S. Application Data

[63] Continuation of Ser. No. 148,421, May 9, 1980, abandoned.

[51] Int. Cl.[3] ..... B22D 11/06; B22D 11/10

[52] U.S. Cl. ..... 164/423; 164/429; 164/437

[58] Field of Search ..... 164/463, 423, 427, 429, 164/437, 133, 335, 418

[56] References Cited

U.S. PATENT DOCUMENTS

| | | | |
|---|---|---|---|
| 908,758 | 12/1908 | Strange et al. | 164/429 |
| 993,904 | 5/1911 | Strange | 164/429 |
| 2,825,108 | 3/1958 | Pono | 164/423 X |
| 3,297,436 | 1/1967 | Duwez | 164/463 X |
| 3,522,836 | 8/1970 | King | 164/463 X |
| 3,605,863 | 9/1971 | King | 164/41 X |
| 3,838,185 | 9/1974 | Maringer et al. | 164/463 X |
| 3,896,203 | 7/1975 | Maringer et al. | 164/463 X |
| 4,077,462 | 3/1978 | Bedell et al. | 164/429 |
| 4,142,571 | 3/1979 | Narasimhan | 164/437 X |
| 4,177,856 | 12/1979 | Liebermann | 164/423 X |
| 4,257,830 | 3/1981 | Tsuya et al. | 164/463 X |

*Primary Examiner*—Nicholas P. Godici
*Assistant Examiner*—J. Reed Batten, Jr.
*Attorney, Agent, or Firm*—Patrick J. Viccaro

[57] ABSTRACT

An apparatus for continuously casting metallic strip material includes a tundish, and a nozzle comprising a curvilinear element, with an orifice passage in the element having substantially uniform cross-sectional dimensions throughout the longitudinal extent thereof. Disposed outside the nozzle is a cooled casting surface movable past the nozzle in a direction substantially perpendicular to the longitudinal axis of the orifice passage. First and second inside surfaces of the element define the orifice passage through which molten metal is fed to the casting surface.

21 Claims, 9 Drawing Figures

STRIP CASTING APPARATUS

This is a continuation of application Ser. No. 148,421, filed May 9, 1980, now abandoned.

BRIEF SUMMARY OF THE INVENTION

Incorporated herein, by reference, is the subject matter of co-filed United States patent application entitled "Method and Apparatus for Strip Casting", Ser. No. 148,359; "Method of Repetitiously Marking Continuously Cast Metallic Strip Material", Ser. No. 148,448; "Apparatus for Strip Casting", Ser. No. 148,440, now abandoned, all of which were filed May 9, 1980 and are assigned to the Assignee of the present application; and "Strip Casting Nozzle", Ser. No. 148,441, filed May 9, 1980, now abandoned.

The present invention relates to the casting of strip material at high quench rates and at high production rates. More particularly, the present invention is directed to an apparatus for rapidly casting thin metallic strip material.

The apparent advantages and economic significance of producing thin metallic strip material by a casting process, as compared to the conventional rolling or reducing operations, are numerous. The fact that strip casting may be performed at such high quench rates to produce amorphous material is even more meaningful. However, it is equally apparent that there are a multitude of strip casting parameters which must be controlled or monitored to assure that the cast strip is of acceptable quality and of uniform composition and structure. For these reasons, those skilled in the art appreciate the intricacy involved in the development of a commercially successful strip casting apparatus.

The general concept of casting thin metallic materials such as sheet, foil, strip and ribbon was disclosed in the early 1900's. For example, U.S. Pat. Nos. 905,758 and 993,904 teach processes wherein molten material flows onto a moving cool surface and the material is drawn and hardened thereon into a continuous thin strip. These references teach that molten metal may be poured onto the smooth peripheral surface of a rotating liquid-cooled copper drum or disc to form strip materials. Despite early disclosure of such concept, there is no evidence of commercial success of strip casting during the early part of the 20th century.

Recently, in U.S. Pat. Nos. 3,522,836 and 3,605,863 a method for manufacturing a continuous product, such as metallic wire or strip, from molten metal has been disclosed. These references teach that a convex meniscus of molten material should project from a nozzle. A heat extracting surfacce, such as a water-cooled drum, is moved in a path substantially parallel to the outlet orifice and into contact with the meniscus of molten metal to continuously draw material from the meniscus to form a uniform continuous product. The above-described method is commonly called the "melt drag" process as the heat extracting surface moving past the meniscus of molten metal at the nozzle orifice actually has an effect on the rate of molten metal flow, or drag, through the nozzle.

More recent strip casting developments focus on relatively narrow refinements in the metallic strip casting art. For example, U.S. Pat. No. 4,142,571 is particularly directed to a slot construction in a metal strip casting nozzle having stringent dimensional requirements. Also, U.S. Pat. No. 4,077,462 pertains to the provision of a specific construction for a stationary housing above the peripheral surface of a chill roll used for strip casting.

There are a number of other rapid quenching techniques known in the art. For example, melt spinning processes of producing metallic filament by cooling a fine molten stream either in free flight or against a chill block have been practiced. Also known are melt extraction techniques, such as crucible melt extraction disclosed in U.S. Pat. No. 3,838,185, pendant drop melt extraction techniques taught in U.S. Pat. No. 3,896,203 and splat cooling explained in U.S. Pat. No. 3,297,436. It has been found difficult to produce uniform sheet or strip by such alternative techniques of rapid quenching. There are many factors, such as casting temperature and pressure, auxiliary surface cooling rates, surface coatings for the casting surface, and the like which appear to affect the product thickness, the quality and the reproducibility of rapidly cast strip material.

Despite the relatively long history of the art of strip casting, and the recent developments in this area, strip casting is not a widely accepted and commercially significant operation at the present time. It appears that various improvements, modifications and innovations are required in the art to effectuate a significant commercial impact in the art of strip casting. In particular, proper relationships among such variables as molten metal tundish construction, nozzle orifice size and dimensions, spacing from a casting surface, speed at which such surface is moved, quench rates, metal temperature and feed rates, and the like may require more accurate identification and interrelation in order to accomplish the uniformity and consistency required for successful, commercial production of cast strip. In particular, certain nozzle structures and their dimensional relationship to the casting surface onto which strip material is cast, have been found to be inadequate to yield uniform strip casting results when utilized in various casting parameters.

Accordingly, a new and improved apparatus for casting relatively wide, thin strip material is desired which overcomes the disadvantages of the prior art structures. Such desired apparatus should be reliable, more efficient and more effective than the structures disclosed in the prior art, and should lead to reproducibility, uniformity and consistency in strip casting.

The present invention may be summarized as providing a new and improved apparatus for continuously casting metallic strip material. Such apparatus comprises a tundish and a nozzle comprising a curvilinear element, with an orifice passage in the element having substantially uniform cross-sectional dimensions throughout the longitudinal extent thereof. Disposed outside the nozzle is a cooled casting surface movable past the nozzle in a direction substantially perpendicular to the longitudinal axis of the orifice passage. First and second inside surfaces of the element define the orifice passage through which molten metal is fed to the casting surface.

Among the advantages of the present invention is the provision of a strip casting apparatus which is capable of continuously casting metallic strip material of substantially uniform dimension and substantially uniform quality throughout its length.

Another advantage of the present invention is the provision of a strip casting apparatus having a nozzle construction which promotes the efficient rapid casting of metal strip material with a minimum of metal turbulence during casting.

An objective of the present invention is to provide a strip casting apparatus capable of reproducing successful strip casting operations.

Another objective of this invention is to provide a strip casting apparatus which can effectuate sufficiently rapid quenching of the produced strip to result in the production of amorphous strip. However, it should be understood that the production of continuously cast crystalline material is equally comprehended by the present invention.

A further objective of this invention is to identify certain design and dimensional requirements, particularly with regard to nozzle structure, which permit continuous and repetitious rapdid casting of metallic strip material of uniform dimension and uniform quality.

These and other objectives and advantages will be more fully understood and appreciated with reference to the following detailed description and the accompanying drawings.

DETAILED DESCRIPTION

Figure 1:
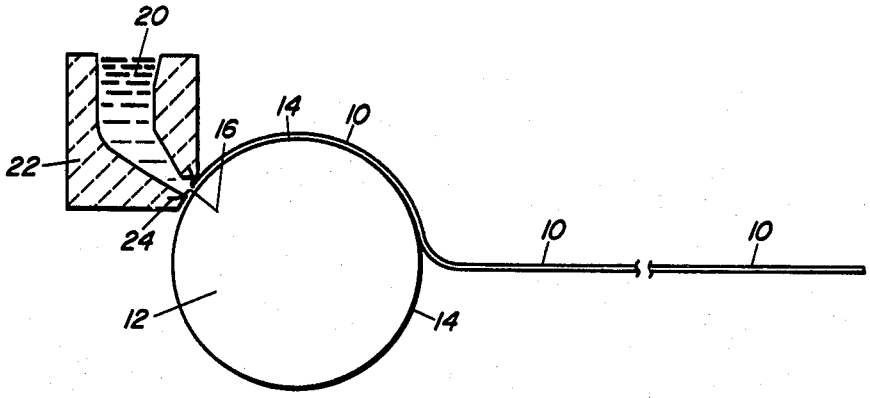
FIG. 1 is an elevation view, partially in cross-section, illustrating a typical apparatus used for continuously casting strip material.

Referring particularly to the drawings, FIG. 1 generally illustrates an apparatus for casting metallic strip material 10 in accordance with the present invention. This apparatus includes a casting drum, wheel, belt, or the like upon which the strip 10 is cast. In a preferred embodiment a continuous strip 10 is cast onto a smooth, outer peripheral surface 14 of a circular drum or wheel as shown in FIG. 1. It should be understood that configurations other than circular may be employed. For example, a wheel with a smooth, frustoconical outer peripheral surface (not shown) may be employed. Also, a belt capable of rotating through a generally ovular path may be employed as the casting element. Regardless of the configuration employed, the casting surface 14 should be cooled to a temperature below the solidus temperature of the metal being cast and should be at least as wide as the strip to be cast.

In a preferred embodiment, the casting element 12 comprises a water cooled, precipitation hardened copper alloy wheel containing about 98% copper with about 2% chromium. Copper and copper alloys are preferable because of their high thermal conductivity and wear resistance, however, beryllium copper alloys, steel, brass, aluminum, aluminum alloys or other materials may be utilized alone, or in combination. For example, multipiece wheels having outer peripheral sleeves of molybdenum or other material may be employed. Likewise, cooling may be accomplished with the use of a medium other than water. Water is typically chosen for its low cost and its ready availability.

In the operation of the strip casting apparatus of the present invention, the surface 14 of the casting wheel 12 must be able to absorb the heat generated by contact with molten metal at the initial casting point 16, and such heat must be conducted substantially into the copper wheel during each rotation of the wheel. The initial casting point 16 refers to the approximate location on the casting 14 where molten metal 20 flowing from the tundish 22 contacts the casting surface 14. Cooling, by heat conduction, may be accomplished by delivering a sufficient quantity of water through internal passageways located near the periphery of the casting wheel 12. Alternatively, the cooling medium may be delivered directly to the underside of the casting surface. Understandably, refrigeration techniques and the like may be employed to accelerate or decelerate cooling rates, and/or to effectuate wheel expansion or contraction during strip casting.

Whether a drum, wheel or belt is employed for casting, the casting surface should be generally smooth and symmetrical to maximize uniformity in strip casting. For example, in certain strip casting operations the distance between the outer peripheral casting surface 14 and the surfaces defining the orifice passage of the nozzle which is feeding the molten material onto the casting surface 14 must not deviate from a desired or set distance during the casting operation. This distance shall hereinafter be called standoff distance or gap. It is understandable that the gap should be substantially maintained throughout the casting operation when it is the intention to cast uniform strip material.

It should be understood that if the casting is performed on a rotating body 12, such as a drum or a wheel, the body 12 should be carefully constructed so as not to be out-of-round during operation to insure uniformity in strip casting. Along these lines, it has been found that a drum or wheel which is out-of-round by about 0.020 inch, or more, may have a magnitude of dimensional instability which unless corrected or compensated during operation, may be unacceptable for certain strip casting operations. It has been found that acceptable dimensional symmetry, as well as the elimination of problems associated with weld porosity may be more readily accomplished by fabricating a wheel or drum from a single, integral slab of cold rolled or forged copper alloy. However, as mentioned above alternative materials including sleeves and coatings may be employed.

The molten material 20 to be cast in the apparatus described herein is preferably retained in a crucible 22, or tundish, which is provided with a nozzle 24. The nozzle is typically, though not necessarily, located at a lower portion of the tundish 22 as shown in FIG. 1. As will be appreciated from the foregoing discussion, the nozzle comprises a curvilinear element 24 in the tundish 22.

Figure 2:
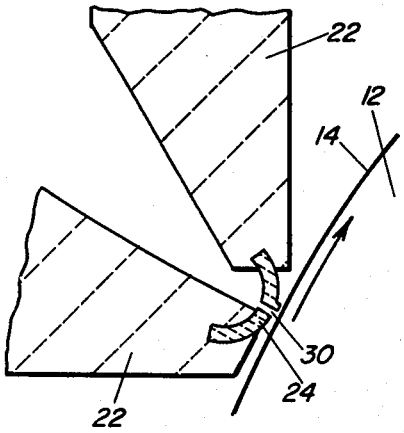
FIG. 2 is a cross-sectional view of a nozzle of the present invention.
Figure 3:
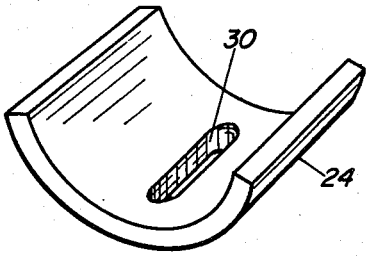
FIG. 3 is a perspective view of a curvilinear element which forms a nozzle of the present invention.

The curvilinear element 24, located in or forming a lower portion of the tundish 22 is best shown in the tundish 22 in FIG. 2, and in perspective view in FIG. 3. As shown in the drawing, an orifice passage 30 is preferably substantially centrally located in the nozzle element 24. Such approximate central location of the orifice passage, or slot, 30 helps to assure uniformity as the pressure of the molten metal bearing thereagainst is substantially equalized during the casting operation. It should be understood, however, that the slot may be located in off-center positions as may be desired.

The longitudinal extent of the orifice passage 30 should approximate the width of the strip to be cast. There does not appear to be a limitation on the longitudinal extent of the orifice passage, and, passages as long as thirty six inches, or longer, in a curvilinear element are comprehended by the present invention. It is highly desired that the molten metal flow uniformly through the orifice passage 30 in the curvilinear element 24 of the present invention in order to form uniform, high quality strip material. In an alternative embodiment, strip of various widths may be produced by cutting multiple longitudinally aligned orifice passages 30 of appropriate longitudinal extent in the curvilinear element 24 forming the nozzle of a tundish 22, as opposed to a single orifice passage 30. Regardless of the size of the orifice passage 30, or passages, the cross-sectional dimensions of each passage 30 should be substantially uniform throughout the longitudinal extent thereof to produce strip material having uniform dimensions. In the operation of the strip casting apparatus of the present invention, the cooled casting surface 14 moves past the orifice passage 30 in a direction substantially perpendicular to the longitudinal axis of the passage 30.

Figure 4:
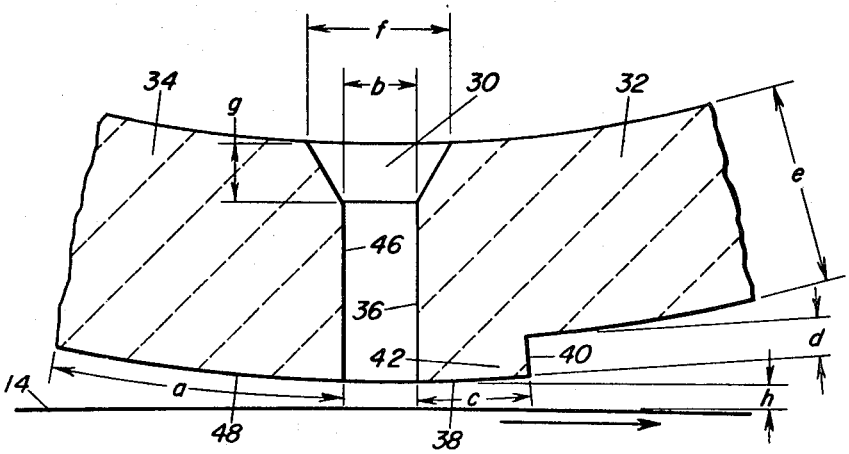
FIG. 4 is an enlarged fragmentary cross-sectional view through the orifice passage of the element shown in FIGS. 2 and 3.

As best shown in FIG. 4, the orifice passage 30 is defined between a first side portion 32 and a second side portion 34 of the curvilinear element 24. The first side portion 32, is located on the downstream side of the orifice passage 30, with respect to the direction of movement of the casting surface 14 indicated by the arrow in FIG. 4. The first side portion 32 has an inside surface 36 which, preferably, is substantially planar, and an outer lip projecting surface 38 disposed toward and facing the casting surface 14. At a downstream location from the orifice passage 30, the outer lip projecting surface 38 is relieved, such as at 40, to define a lip projection 42. The second side portion 34 is located on the upstream side of the orifice passage 30, with respect to the direction of movement of the casting surface 14 indicated by the arrow in FIG. 4. The second side portion 34 has an inside surface 46, which preferably, is substantially planar and, also preferably, is substantially parallel to and facing the inside surface 36 of the first side portion 32 at least at an outer portion of the orifice passage 30 with respect to the direction of metal flow from the tundish 22 through the passage 30. A bottom surface 48 of the second side portion 34 is disposed toward and facing the casting surface 14.

In a preferred embodiment, the outer lip projecting surfacce 38 of the first side portion 32 and a portion of the bottom surface 48 of the second side portion 34 are in substantially complete parallelism with the casting surface 14 movable therebelow. When utilizing a drum or wheel, and a grindable curvilinear element 24, such substantially complete parallelism may be accomplished by placing a sheet of sandpaper, or the like, against the casting surface 14 with the grit side of the sandpaper facing the curvilinear element 24. By moving the curvilinear element 24 into tight contact with the casting surface 14, with the sandpaper disposed therebetween, and by moving the casting surface 14 and sandpaper simultaneously past the nozzle 24, the outer lip projecting surface 38 of the first side portion 32 and the bottom surface 48 of the second side portion 34 are ground by the grit side of the sandpaper into substantially complete parallelism with the casting surface 14. Such parallelism may be achieved on most refractory nozzles, even when round or other curvilinear casting surfaces are employed. To achieve such parallelism by this procedure 400 or 600 grit sandpaper has been found to be adequate.

Figure 7:
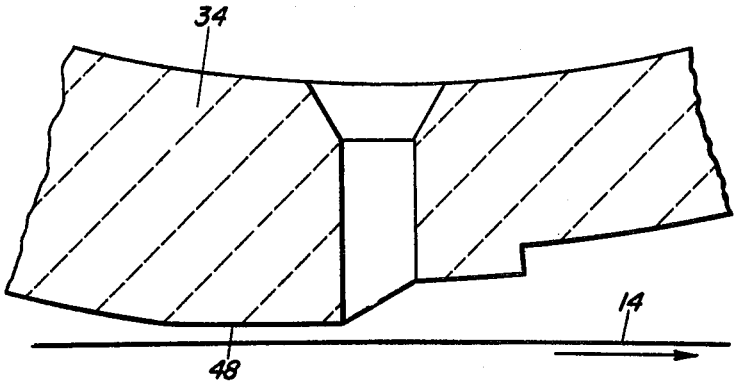
FIG. 7 is an enlarged, fragmentary cross-sectional view, illustrating an alternative orifice passage in an element of the present invention.
Figure 8:
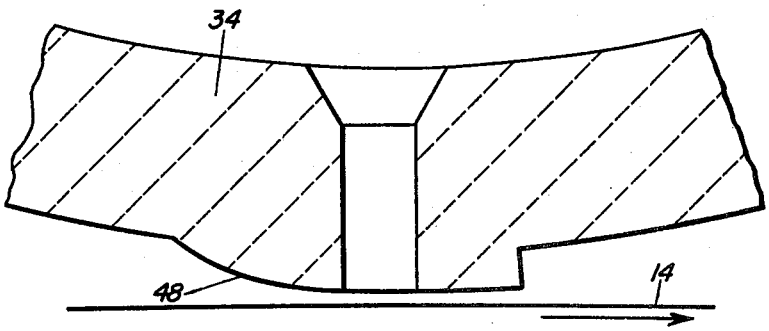
FIG. 8 is an enlarged fragmentary, cross-sectional view, illustrating an alternative orifice passage in an element of the present invention.

By maintaining at least a portion of the outer lip projecting surface 38 in complete parallelism with the casting surface 14, the standoff distance, or gap h, between the outer lip projecting surface 38 and the casting surface 14 may be maintained throughout the length of the projection 42. It has been found that the gap h between the outer lip projecting surface 38 and the casting surface 14 must be maintained at less than about 0.120 inch in order to successfully cast strip material. Preferably, this gap h is maintained at less than about 0.080 inch and for casting certain alloys into thin gage strip, a gap h of less than 0.010 is preferred and may range from 0.003 to 0.006 inch. It has also been found that the gap h between the bottom surface 48 of the second side portion 34 does not appear to be as critical. What is preferred with respect to the second side portion 34 is that the inside surface 46 thereof extend toward the casting surface 14 while parallel to the inside surface 36 of the first side portion 32, at least in an outer portion of the orifice passage 30, so as not to interfere with the maintenance of a stable flow of molten metal through the passage 30 in the curvilinear element 24 and onto the moving casting surface 14. Accordingly, the bottom surface 48 of the second side portion 34 may just clear the casting surface 14, i.e. within about 0.002 inch as shown in FIG. 7, or, alternatively, the bottom surface 48 may be tapered from the orifice in a direction away from the casting surface 14, as shown in FIG. 8. In any event, the gap h between the bottom surface 48 of the second side portion 34 and the casting surface 14 must be sufficiently restricted at the nozzle to prevent significant molten metal backflow therebetween during casting.

Figure 5:
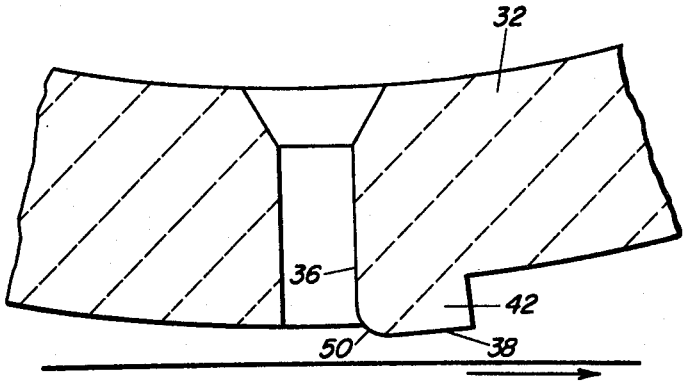
FIG. 5 is an enlarged fragmentary cross-sectional view through the orifice passage of an alternative element of the present invention.

In an alternative embodiment, shown in FIG. 5, the inside surface 36 of the first side portion 32 extends through a curvilinear surface 50 to the outer lip projecting surface 38, rather than through the abrupt 90° juncture shown in FIG. 4. Providing such radiused corner surface 50 has been found beneficial in the production of certain grades of strip material. More particularly, such radiused corner surface 50 helps minimize molten metal turbulence during strip casting and, therefore, results in more uniform production parameters. It has also been found that a sharp corner between the inside surface 36 and the outer lip projecting surface 38 may be subjected to various pressures and flow patterns which could create stress conditions for curvilinear elements 24 made of certain materials and, in some instances, may break, crack or wear during casting thereby upsetting balanced strip casting conditions. Providing such rounded corner surface 50 may minimize the adverse affects of such turbulence and metal flow through the curvilinear element 24 comprising the nozzle of the tundish 22.

To further minimize turbulence during strip casting through the apparatus of the present invention, an inside portion of the orifice passage 30 may be relieved, or tapered. As shown in the drawing, both the first side portion 32 and the second side portion 34 may be cut into a V-shape, or a more rounded U-shape at an inside portion thereof, creating an initial funnel type structure, which further maximizes uniformity in metal flow patterns and minimizes irregularities or turbulence during strip casting.

Figure 9:
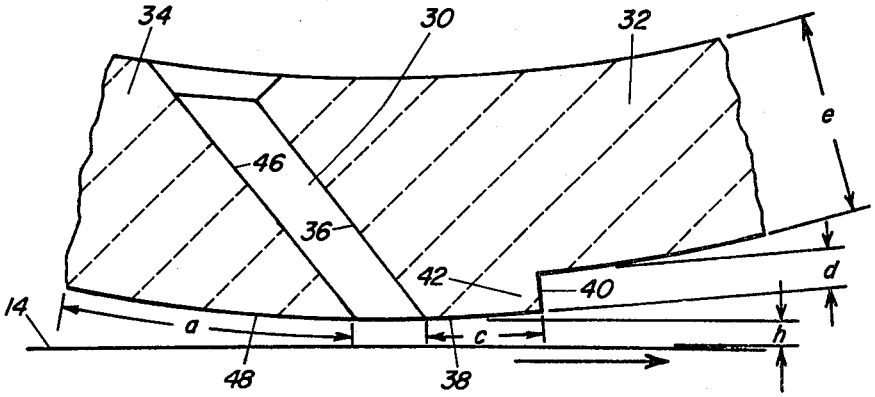
FIG. 9 is an enlarged fragmentary cross-sectional view illustrating an alternative orifice passage in an element of the present invention.

Another preferred arrangement, which minimizes molten metal turbulence during strip casting, is to arrange the curvilinear element 24 at an angle such that the metal is fed in the same direction as the casting surface 14. This may be accomplished by disposing the inside surfaces 36 and 46, defining the orifice passage 30, toward the casting surface 14 at an angle of less than about 90°, or preferably at an angle of about 45° as shown in FIG. 9. By such arrangement the flowing molten metal is not subjected to as severe a change in flow rate as would be experienced by arranging the orifice passage 30 to feed molten metal perpendicular to the casting surface 14.

The crucible 22 is preferably constructed of a material having superior insulating ability. If the insulating ability is not sufficient to retain the molten material at a relatively constant temperature, auxiliary heaters such as induction coils may have to be provided in and/or around the crucible 22, or resistance elements such as wires may be provided. A convenient material for the crucible is an insulating board made from fiberized kaolin, a naturally occurring, high purity, alumina-silica fire clay. Such insulating material is available under the trade name Kaowool HS board. However, for sustained operations, and for casting higher melting temperature alloys, various other materials may have to be employed for constructing the crucible 22 or the curvilinear element 24 including graphite, alumina graphite, quartz, clay graphite, boron nitride, silicon nitride, silicon carbide, boron carbide, alumina, zirconia and various combinations or mixtures of such materials. It should also be understood that these materials may be strengthened; for example fiberized kaolin may be strengthened by impregnating with a silica gel or the like.

Figure 6:
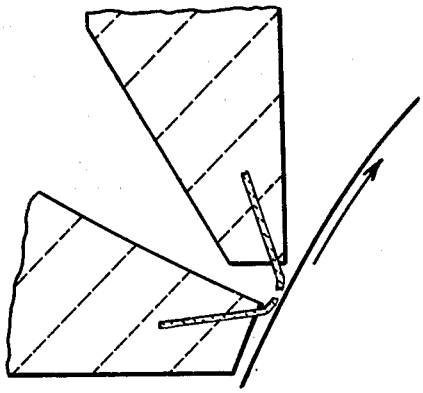
FIG. 6 is a cross-sectional view of the orifice passage of an alternative element of the present invention.

It is imperative that the orifice passage 30 of the curvilinear element 24 remain open and its configuration remain substantially stable throughout a strip casting operation. It is understandable that the orifice passage 30 should not erode or clog, significantly, during a strip casting sequence or the primary objectives of maintaining uniformity in the casting operation and of minimizing metal flow turbulence in the tundish 22 may be defeated. Along these lines, it appears that certain insulating materials may not be able to maintain their dimensional stability over long casting periods. To obviate this problem, side portions 32 and 34 forming the orifice passage 30 of the curvilinear element 24 may be constructed of a material which is better able to maintain dimensional stability and integrity during exposure to high molten metal temperatures for prolonged time periods. Such materials may take the form of a single, generally semi-circular element 24 with a slot 30 cut therethrough as shown in FIG. 3. Alternatively, the curvilinear element 24 may comprise a pair of facing inserts held in the crucible 22 to form a slot 30 therebetween as shown in FIG. 6. In a preferred embodiment the orifice passages 30 in single curvilinear elements 24 may be cut ultrasonically to insure that the desired slot dimensions are accurately provided. Such curvilinear elements 24 may be constructed of materials such as quartz, graphite, clay graphite, boron nitride, alumina graphite, silicon carbide, stabilized zirconia silicate, zirconia, magnesia, alumina, or other similar molten metal resistant material. These curvilinear elements 24 may be held in the crucible 22 mechanically, and/or with the aid of adhesives such as various refractory cements.

The drive system and housing for the drum, wheel or other casting surface 14 of the present invention should be rigidly constructed to permit drum rotation without structural instability which could cause the drum to slip or vibrate. In particular, care should be taken to avoid resonant frequences at the operating speeds for the casting surface 14. The casting surface 14 should be capable of moving at a surface speed of from about 200 linear surface feet per minute, and preferably 1800 to about 4000 linear surface feet per minute to more that about 10,000 linear surface feet per minute. When utilizing a drum having a circumference of about 8 feet, this rate calculates to a drum speed from about 25 rpm to about 1250 rpm. A three horsepower variable speed reversible, dynamically braked motor provides an adequate drive system for an integral copper alloy casting drum about 2 inches thick and about 8 feet in circumference.

In one embodiment, the casting surface 14 on the wheel or drum of the apparatus of the present invention is smooth. It has been found that in certain applications, such as for producing amorphous materials, finishing the peripheral surface 14 of a casting drum 12 with 400-grit paper and preferably with 600-grit paper may yield improved product uniformity.

In a preferred embodiment as illustrated in FIG. 2, the crucible 22 is constructed of an insulating board, such a Kaowool HS Board, and the curvilinear element 24, as shown in FIG. 3, is made of clay graphite, a molten metal resistant material, held in the walls of the crucible 22. The orifice passage 30 is cut ultrasonically in the clay graphite element 24. The first side portion 32 and the second side portion 34 of the curvilinear element 24 define the orifice passage, or slot, 30 therebetween. As an alternative, preferred examples of curvilinear element 24 materials, a plate made of quartz or vycor material, which are highly molten metal resistant materials, having a width such as about one and one-half inch may be bent around an appropriate small radius, as shown in the drawing. Alternatively, the curvilinear element 24 may comprise cast boron nitride. The desired slot forming the orifice passage 30 in the curvilinear element 24, may be accurately cut therein with an ultrasonic drill. A preferred one piece, curvilinear element 24, as best illustrated in FIGS. 2, 3 and 4 may be constructed of a semi-circular ring of molten metal resistant material. In this example, a slot b having a width of about 0.010 to about 0.080 inch between parallel inside surfaces 36 and 46 may be ultrasonically drilled into a clay graphite insert material, and the insert may be mounted into the crucible 22 as shown in FIG. 2. It should be understood that the design of the outer, peripheral edges of such curvilinear element nozzle may be modified to assist in holding the curvilinear element 24 in the walls of the crucible 22.

A preferred orifice passage 30 in a curvilinear element 24 of the apparatus of the present invention is shown in enlarged cross-section in FIG. 4. In one embodiment of this apparatus, the dimensions indicated in FIG. 4 may have the following preferred limitations.

| dimension | designation | preferred limitation | more preferred limitation |
|---|---|---|---|
| a | bottom surface of second side portion | at least .001 inch | .25–.50 inch |
| b | width of orifice passage | .010–.080 inch | .025–.035 inch |
| c | outer lip projecting surface length | .01–.16 inch | .02–.06 inch |
| d | relief distance | at least .01 inch | at least .04 inch |

In the production of amorphous strip materials, the width b of the orifice passage 30 is typically in the range of from about 0.010 to 0.040 inch. In the production of crystalline strip material, such as stainless steel, the width b of the orifice passage 30 may be greater, perhaps as high as about 0.080 inch if thick strip is being uniformly produced in accordance with the present invention.

Dimension e, representing the cross-sectional thickness of the curvilinear element 24, f, representing the width to which a top portion of the orifice passage 30 may be relieved, and g, representing the depth to which a top portion of the orifice passage 30 may be relieved, appear to be somewhat arbitrary. Primarily, the purpose of the relief at a top portion of the orifice passage 30, identified by dimensions f and g in FIG. 4, is to eliminate clogging of molten metal in the orifice.

Molten metal turbulence during strip casting may be minimized, and perhaps avoided by relieving sharp corners of the nozzle in the direction of casting. It will be understood that such corner relief, such as the radiused corner surface 50 shown in FIG. 5, may be accomplished by constructing the curvilinear element 24 of an eroding material, such as Kaowool HS board, which may provide natural erosion as a result of the strip casting operation. Turbulence may also be avoided by completely rounding the corner 50 of the projection 42 on the first side portion 32 of the curvilinear element 24 as is shown in FIG. 5 during or after manufacture thereof.

In an exemplary operation of the apparatus of the present invention, molten metal is delivered to a heated crucible 22. It is understood that a heater, such as induction coils of resistance wire, may be provided in and above the crucible 22 to maintain relatively constant molten metal temperatures as may be desired. Alternatively, the molten metal may be poured directly into a preheated crucible. The preheat temperature should prevent freezing or clogging of the orifice passage 30 during the initial casting operation, and the temperature of the flowing metal should thereafter keep the crucible 22 and curvilinear element 24 forming the nozzle at sufficient temperature to insure uninterrupted molten metal flow through the orifice passage 30. In certain applications, the curvilinear element 24 may be externally heated throughout the casting operation. Also, the metal which is fed to the crucible 22 may be superheated to allow a certain degree of temperature loss without adversely affecting metal flow through the orifice passage 30.

Also, a metallostatic head height in the tundish 22 should be maintained at a relatively constant level, typically at less than ten inches above the orifice passage 30, throughout the casting operation to assure that a relatively constant static head pressure may be maintained at the orifice passage 30. This may be accomplished by initially pouring the molten metal 20 into the crucible 22 to the desired height and thereafter controlling the rate at which additional molten metal 20 is poured into the crucible 22 to maintain the desired metallostatic head. It is understandable that the rate at which additional molten metal 20 is fed to the crucible 22 should be in substantial conformity with the rate at which metal flows from the orifice passage 30 onto the casting surface 14 in forming strip material 10. Maintenance of a relatively constant height of metal in the crucible 22 assures that the molten metal flow pressure through the orifice passage 30 is maintained relatively constant so as not to adversely affect the casting operation or the quality of the strip material 10. Alternatively, externally applied pressure may be employed to control the pressure at the orifice passage 30.

Using a tundish or crucible 22 similar to that shown in FIG. 1, made of a commercially available tundish material available under the trade name Garnex, a casting run was made on Type 304 stainless steel. The orifice passage 30 at the base of the crucible was about 1.3 inches long by 0.08 inch wide, and the distance, or gap, between the outer, lip projecting surface 38 and casting surface 14 was between 0.02 to 0.04 inch. With the speed of a rotating water cooled copper alloy drum held at about 930 feet per minute, molten metal was poured into the crucible 22 at a temperature of about 2,900° F. estimated with the use of an optical pyrometer. A metallostatic head height of approximately six inches was maintained throughout the casting operation. The strip produced thereby was about 0.006 to 0.008 inch thick and exhibited fairly good quality in that it was tough and ductile as cast.

During casting of strip material, the tendency of the strip 10 to adhere to the casting surface 14 for a significant distance, such as several feet or more, beyond the initial casting point 16 has been observed. It is understandable that if the strip material 10 remains on a rotating casting drum or wheel 12 for a full revolution, damage to the crucible 22, particularly to the orifice passage 30 in the curvilinear element 24, could result. It has been found that the use of a doctor blade, such as a knife type element riding at or near the drum surface 14, approximately 2.5 to 6 feet from the orifice easily counters such adherence. With such an arrangement, the cast strip may be removed from the drum 12 by such doctor blade. Such doctor blade has been found particularly useful in the production of thinner amorphous strip materials which appear to have a greater tendency to adhere to the casting surface 14 than do the crystalline strip materials. It is believed that the force which retains the strip on the casting surface may reflect the quality of the thermal contact between the strip 10 and the casting surface 14. Alternative arrangements, such as an air knife, may also be employed to separate the strip 10 from the wheel 12.

The casting of relatively high quality strip material including amorphous material, which for the purpose of this invention includes materials which are at least 25% amorphous, is feasible and practical using the apparatus and procedures described above. Understandably, the quench rates must be higher for amorphous material as compared to similar gage crystalline strip material. Quench rates may be accelerated such as by increasing the speed of the casting surface 14, or the like. It is important to recognize that the process may be conducted in two effective modes. With the orifice passage 30 quite close to the casting surface 14 as measured between the outer lip projecting surface 38 and the casting surface 14, strip perhaps 0.001 to 0.003 inch thick can be cast of either amorphous or crystalline materials. If the outer lip projecting surface 38 of the first side portion 32 of the curvilinear element 24 is disposed further away from the casting surface 14, and as casting surface speeds are reduced, strip perhaps 0.005 to 0.050 inch thick can be cast. In this later mode, the quench rate may be significantly lower due at least in part to the increase in the product thickness.

Whereas the preferred embodiment has been described above for the purposes of illustration, it will be apparent to those skilled in the art that numerous variations of the details may be made without departing from the invention.

I claim:

1. An apparatus for continuously casting metal strip comprising:

a tundish for receiving and holding molten metal, a nozzle comprising at least one separate substantially U-shaped curvilinear element disposed in the tundish and opening into the tundish, said curvilinear element having an elongated orifice passage therein defined between a first side portion and a second side portion of the curvilinear element, the orifice passage extending along the length of the U-shaped curvilinear element and approximating the width of the strip to be cast, said orifice passage having substantially uniform cross-sectional dimensions throughout the longitudinal extent thereof, and a cooled casting surface at least as wide as the strip to be cast, disposed at a standoff distance of less than 0.120 inch from the nozzle, movable past a discharge end of the orifice passage in a direction substantially perpendicular to the longitudinal axis of the orifice passage, said first side portion located downstream with respect to the direction of movement of the casting surface and having substantially planar inside surfaces defining the orifice passage, and an outer, lip projecting surface at the discharge end of the orifice passage disposed toward, facing and in complete parallelism with the casting surface for a length of at least 0.01 inch, the outer, lip projecting surface of the first side portion being relieved to define a lip projection at a location beginning at the point of termination of complete parallelism.

2. An apparatus as set forth in claim 1 wherein:

said second side portion has a substantially planar inside surface substantially parallel to and facing the inside surface of the first side portion at least at a lower portion of said orifice passage, and a bottom surface disposed toward, and facing the casting surface.

3. An apparatus as set forth in claim 1 wherein the orifice passage is substantially centrally located in the curvilinear element.

4. An apparatus as set forth in claim 1 wherein the casting surface is movable past the nozzle at a rate of from about 200 to about 10,000 linear surface feet per minute.

5. An apparatus as set forth in claim 1 wherein the casting surface is movable past the nozzle at a rate of from about 1,800 to about 4,000 linear surface feet per minute.

6. An apparatus as set forth in claim 3 wherein an inside portion of the orifice passage defined between the inside surface of the first side portion and the inside surface of the second side portion tapers inwardly from the molten metal holding portion of the nozzle to the location where said inside surfaces are parallel to one another.

7. An apparatus as set forth in claim 1 wherein the standoff distance between the outer, lip projecting surface and the casting surface is less than about 0.080 inch.

8. An apparatus as set forth in claim 1 wherein the outer, lip projecting surface extends for a length of at least 0.02 inch before the projecting surface is relieved to define the lip projection.

9. An apparatus as set forth in claim 1 wherein an integral curvilinear surface is provided between the inside surface of the first side portion and the outer, lip projecting surface of the first side portion.

10. An apparatus as set forth in claim 3 wherein a standoff distance of less than about 0.080 inch is maintained between the bottom surface of the second side portion surface and the casting surface.

11. An apparatus as set forth in claim 1 wherein the casting surface comprises a peripheral surface of a water cooled wheel.

12. An apparatus as set forth in claim 12 wherein the wheel is made of a metal selected from the group consisting of copper, copper alloy, aluminum, aluminum alloy, steel, molybdenum and combinations thereof.

13. An apparatus as set forth in claim 3 wherein at least a portion of the bottom surface of the second side portion is in complete parallelism with the casting surface therebelow.

14. An apparatus as set forth in claim 1 wherein the distance between the casting surface and the parallel, facing outer, lip projecting surface of the first side portion is less than about 0.025 inch.

15. An apparatus as set forth in claim 1 wherein the distance between the casting surface and the parallel, facing outer lip projecting surface of the first side portion is less than about 0.010 inch.

16. An apparatus as set forth in claim 1 wherein the distance between the casting surface and the parallel, facing outer lip projecting surface of the first side portion is from about 0.003 to 0.006 inch.

17. An apparatus as set forth in claim 1 wherein the distance between the parallel facing inside surfaces defining at least an outer portion of the orifice passage is from about 0.010 to 0.035 inch.

18. An apparatus as set forth in claim 3 wherein a standoff distance of less than about 0.002 inch is maintained between the bottom surface of the second side portion and the casting surface.

19. An apparatus as set forth in claim 2 wherein the inside surfaces defining the orifice passage are disposed toward the casting surface at an angle of less than 90°.

20. An apparatus as set forth in claim 1 wherein the inside surfaces defining the orifice passage are disposed toward the casting surface at an angle of about 45°.

21. An apparatus as set forth in claim 1 wherein the curvilinear element is constructed of a material selected from the group consisting of graphite, alumina graphite, clay graphite, quartz, fiberized kaolin, boron nitride, silicon nitride, silicon carbide, boron carbide, alumina, zirconia, stabilized zirconia silicate, magnesia and combinations thereof.

* * * * *

UNITED STATES PATENT OFFICE

CERTIFICATE OF CORRECTION

Patent No. 4,479,528 Dated October 30, 1984

Inventor(s) Robert E. Maringer

It is certified that error appears in the above-identified patent and that said Letters Patent are hereby corrected as shown below:

In the patent, sheet 1, please correct Item [73] to read as follows:

-- [73] Assignee: Battelle Development Corporation, Columbus, Ohio --

Claim 6, line 1, delete "3" and insert -- 2 --.

Claim 12, line 1, delete "12" and insert -- 11 --.

Claim 13, line 1, delete "3" and insert -- 2 --.

Claim 19, line 1, delete "2" and insert -- 1 --.

Signed and Sealed this

Sixteenth Day of April 1985

[SEAL]

*Attest:*

DONALD J. QUIGG

*Attesting Officer* *Acting Commissioner of Patents and Trademarks*